US005291686A

United States Patent [19]

Sears et al.

[11] Patent Number: 5,291,686

[45] Date of Patent: Mar. 8, 1994

[54] OVERHEAD DOOR SAFETY APPARATUS

[76] Inventors: Russ Sears, 95 County Road 14, Mount Brydges, Canada; Dave Winser, 381 Waterloo St. 190 4, London, Ontario, Canada, N6B 2R2

[21] Appl. No.: 986,446

[22] Filed: Dec. 7, 1992

[51] Int. Cl.[5] ..... E05D 13/00

[52] U.S. Cl. ..... 49/322; 49/13; 49/197

[58] Field of Search ..... 49/197, 198, 199, 200, 49/201, 202, 322, 13, 14; 187/81-88

[56] References Cited

U.S. PATENT DOCUMENTS

| | | | |
|---|---|---|---|
| 2,103,324 | 12/1937 | Down | 49/13 X |
| 2,137,196 | 11/1938 | Sampson | 49/13 X |
| 2,185,828 | 1/1940 | Blodgett | 49/322 |
| 2,651,817 | 9/1953 | Moler | 49/322 X |
| 3,188,698 | 6/1965 | Zoll et al. | 49/322 |
| 3,579,910 | 5/1971 | Wetter | 49/322 |
| 4,385,471 | 5/1983 | Gabry et al. | 49/322 |
| 4,520,591 | 6/1985 | Calvagno | 49/322 |
| 4,725,185 | 2/1988 | Neagu | 187/81 X |
| 4,914,862 | 4/1990 | Gregory | 49/322 |
| 4,956,938 | 9/1990 | DeMent | 49/322 X |

FOREIGN PATENT DOCUMENTS

| | | | |
|---|---|---|---|
| 1173336 | 2/1959 | France | 49/322 |

*Primary Examiner*—Peter M. Cuomo
*Assistant Examiner*—Jerry Redman
*Attorney, Agent, or Firm*—S. Michael Bender

[57] ABSTRACT

A new and improved overhead door safety apparatus is disclosed for a cable controlled door whose movement is guided by a stationary guide track. The new apparatus includes a brake assembly which is attached to the door and which is responsive to a decrease in a predetermined cable tension. When the decrease in the predetermined cable tension takes place, the overhead door safety apparatus is actuated causing the brake assembly to apply a braking action on movement of the overhead door. More specifically, in the brake assembly, a cable-tension-responsive track follower guides motion of the door by following the track. The cable-tension-responsive track follower has a first and a second operating state. The first operating state permits smooth movement of the cable-tension-responsive track follower along the track as the door moves when a control cable maintains a predetermined amount of cable tension. The second operating state of the cable-tension-responsive track follower is automatically actuated and automatically provides a braking action against the track to halt movement of the overhead door when a control cable has less than the predetermined amount of cable tension, such as when a counterbalance spring breaks or when the cable itself breaks.

3 Claims, 3 Drawing Sheets

OVERHEAD DOOR SAFETY APPARATUS

BACKGROUND OF THE INVENTION

1. Field of the Invention

The present invention relates generally to overhead garage doors, and more particularly, to a safety device to prevent the overhead door from moving downward in the event of a failure in tension of a control cable.

2. Description of the Prior Art

The use of both manually operated and power operated overhead garage doors is well known in the art. In addition, special apparatus to deal with certain unsafe conditions associated with such overhead garage doors are also known.

For example, U.S. Pat. No. 3,958,367 of Fairman discloses an overhead garage door that has elongated coil springs to substantially balance the door weight for ease of opening the door. A safety device is provided in the event that a coil spring breaks. The safety device employs an elongated flexible member that extends longitudinally axially through the elongated springs and substitutes for the spring in the event that the spring breaks. The extent to which the door moves after breakage of a spring depends upon the extent of stretching that the elongated flexible safety member undergoes after the spring breaks. Moreover, if a control cable breaks, the door will not be restrained from rapidly moving downward.

U.S. Pat. No. Des. 262,939 of Shook et al discloses a safety locking device for garage doors which includes a hinged flap.

U.S. Pat. No. 4,269,253 of Ziegler discloses a garage door with safety guards installed over the gaps between hingedly connected horizontal panels to prevent fingers from being caught between the horizontal panels.

U.S. Pat. No. 4,640,049 of Duncan discloses a safety device for overhead garage door counterbalance springs. A flexible safety cable extends through the open center of the spring and is anchored at each end to the garage structure. The safety cable is placed under sufficient tension to contain the spring against horizontal or vertical movement in the event that the spring breaks. The extent to which the door moves after breakage of a spring depends upon the extent of stretching that the flexible safety cable undergoes after the spring breaks. Moreover, if a control cable breaks, the door will not be restrained from rapidly moving downward.

U.S. Pat. No. 4,757,853 of Price discloses a safety device for garage door springs that are used to couterbalance the weight of the door. An elongated flexible member extends longitudinally through each of the coil springs and is anchored at each end to fixed supports. If spring breaks, broken portions of the spring will be retained on the elongated flexible member. The extent to which the door moves after breakage of a spring depends upon the extent of stretching that the elongated flexible member undergoes after the spring breaks. Moreover, if a control cable breaks, the door will not be restrained from rapidly moving downward.

U.S. Pat. No. 4,956,938 of DeMent discloses a safety device for a power operated overhead door which is operated by wire control cables for raising and lowering the door. A cam plate having a toothed edge is pivotably moved to instantaneously clamp or bind against the wire control cable to stop its downward movement in the event that any obstacle such as a small child, is detected in the path of the door while it is being closed. However, the cam plate is biased to permit the wire control cable to move in a direction to open the door even after the safety device is actuated. Moreover, if a control cable breaks, the door will not be restrained from rapidly moving downward.

Thus, while the foregoing body of prior art indicates that it is well known to use safety devices to protect against damage or injury from broken counterbalance springs, that it is well known to grab a tensioned control cable to prevent an overhead door from moving lower onto a sensed child who stands under the door, and that it is well known to guard against a person's fingers being caught between adjacent horizontal panels of an overhead garage door, the provision of a simple and cost effective device for automatically halting downward movement of an overhead garage door, in the event that tension in a control cable is abruptly lost, is not disclosed.

In this respect, the prior art described above does not teach or suggest the provision of a simple and cost effective device for automatically halting downward movement of an overhead garage door in the event that tension in a control cable is abruptly lost device due to either breakage in a counterbalance spring or breakage in the control cable. The foregoing disadvantages are overcome by the unique overhead door safety apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved overhead door safety apparatus for a cable controlled door whose movement is guided by a stationary guide track. The new apparatus includes a brake assembly which is attached to the door and which is responsive to a decrease in a predetermined cable tension. When the decrease in the predetermined cable tension takes place, the overhead door safety apparatus of the invention is actuated causing the brake assembly to apply a braking action on movement of the overhead door. More specifically, in the brake assembly, a cable-tension-responsive track follower guides motion of the door by following the track. The cable-tension-responsive track follower has a first and a second operating state. The first operating state permits smooth movement of the cable-tension-responsive track follower along the track as the door moves when a control cable maintains a predetermined amount of cable tension. The second operating state of the cable-tension-responsive track follower is automatically actuated and automatically provides a braking action against the track to halt movement of the overhead door when a control cable has less than the predetermined amount of cable tension, such as when a counterbalance spring breaks or when the cable itself breaks.

More specifically, the cable-tension-responsive track follower is preferably comprised of an oblong brake plate which has a first, relatively short external diameter, and has a second, relatively long external diameter. The oblong brake plate is positioned on the overhead door so that, when the short external diameter is substantially perpendicular to the track and the long external diameter is substantially parallel to the track (this position being designated as the first or "normal" position for the cable-tension-responsive track follower), either a gap exists between the brake plate and the track, or a smooth surface contact exists between the brake plate and the track. As a result, in the "normal" state, movement of the brake plate against the track is smooth and continuous.

On the other hand, when the long external diameter of the oblong plate is moved from the normal position of being substantially parallel to the track to a second position approaching being perpendicular to the track, (this position being designated as the second or "braking" position for the cable-tension-responsive track follower), the gap between the brake plate and the track is eliminated, and a rough surface contact takes place between the oblong brake plate and the track. As a result, in the "braking" state, movement of the brake plate against the track is braked, and movement of the door is halted.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract of the Disclosure is neither intended to define the invention or the application, which only is measured by the claims, nor is it intended to be limiting as to the scope of the invention in any way.

It is therefore an object of the present invention to provide a new and improved overhead door safety apparatus which has all of the advantages of the prior art and none of the disadvantages.

It is another object of the present invention to provide a new and improved overhead door safety apparatus which may be easily and efficiently manufactured and marketed.

It is a further object of the present invention to provide a new and improved overhead door safety apparatus which is of durable and reliable construction.

An even further object of the present invention is to provide a new and improved overhead door safety apparatus which is susceptible of a low cost of manufacture with regard to both materials and labor, and which accordingly is then susceptible of low prices of sale to the consuming public, thereby making such overhead door safety apparatus available to the buying public.

Still yet a further object of the present invention is to provide a simple and cost effetive device for automatically halting downward movement of an overhead garage door in the event tha tension in a control cable is abruptly lost.

Still another object of the present invention is to provide a simple and cost effective device for automatically halting downward movement of an overhead garage door in the event that tension in a control cable is abruptly lost due to breakage in a counterbalance spring.

Yet another object of the present invention is to provide a simple and cost effective device for automatically halting downward movement of an overhead garage door in the event that tension in a control cable is abruptly lost device due to breakage in the control cable.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
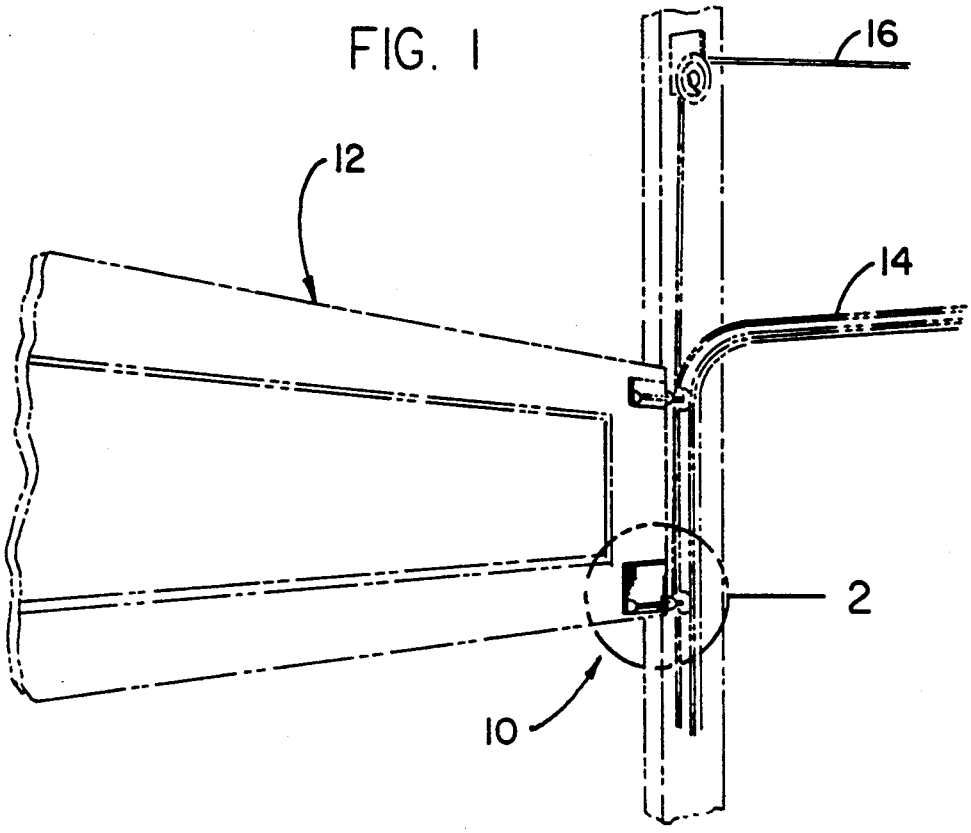
FIG. 1 is a perspective view showing a first preferred embodiment of the overhead door safety apparatus of the invention installed on an overhead garage door.

With reference to the drawings, a new and improved overhead door safety apparatus embodying the principles and concepts of the present invention will be described.

Turning initially to FIGS. 1–4, there is shown a first exemplary embodiment of the overhead door safety apparatus of the invention generally designated by reference numeral 10. In its preferred form, the overhead door safety apparatus 10 is installed on a cable-controlled overhead door 12 whose movement is guided by a stationary guide track 14. The overhead door safety apparatus 10 is responsive to a predetermined decrease in the tension provided by cable 16. Broadly stated, when the decrease in predetermined cable 16 tension takes place, the overhead door safety apparatus 10 is actuated causing the brake assembly 11 to apply a braking action on the overhead door 12. More specifically, in the brake assembly 11, a cable-tension-responsive track follower 18 guides motion of the door 12 by following the track 14. The cable-tension-responsive track follower 18 has a first operating state and a second operating state.

Figure 3:
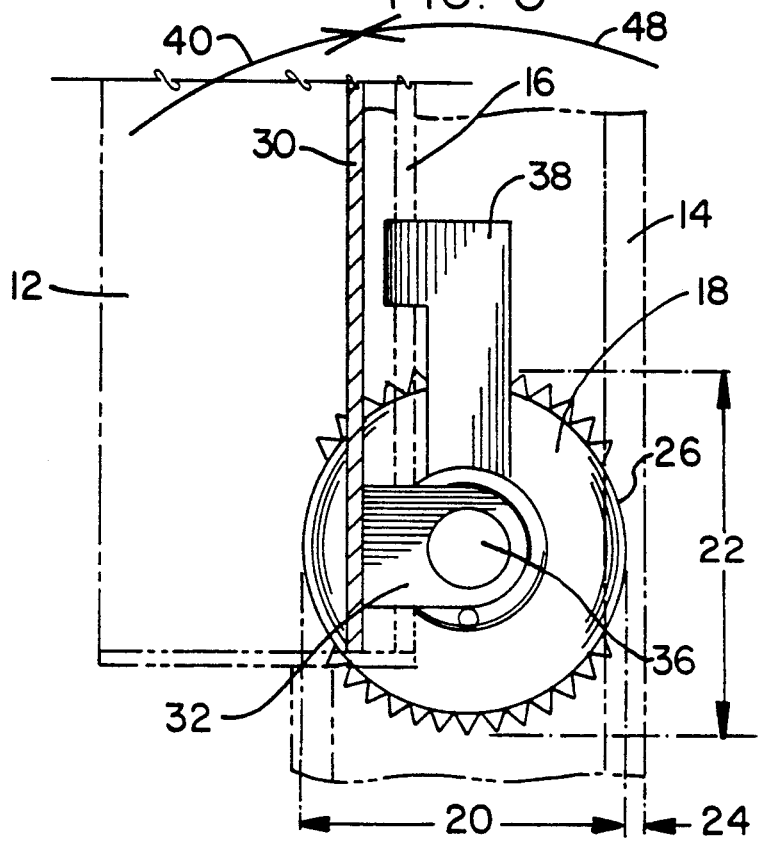
FIG. 3 is a side elevational view of the embodiment of the overhead door safety apparatus of the invention shown in FIG. 2 taken along the line 3—3 thereof where the safety device is in a normal operating position where proper predetermined cable tension is present.

As shown in FIG. 3, the first operating state permits smooth movement of the cable-tension-responsive track follower 18 along the track 14 when the control cable 16 maintains a predetermined amount of cable 16 tension. The predetermined tension of the cable 16 is indicated by the fact that the cable 16 is oriented in a vertical orientation.

Figure 4:
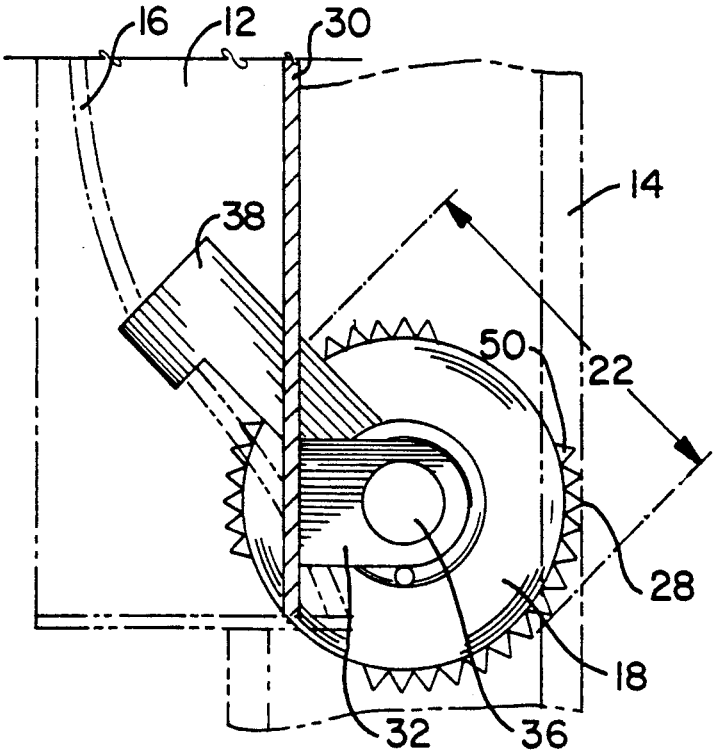
FIG. 4 is a side elevation view, similar to the view in FIG. 3, except that the overhead door safety apparatus of the invention is in the position for braking door movement because tension in the cable has been reduced below the predetermined tension level.

As shown in FIG. 4, the second operating state of the cable-tension-responsive track follower 18 is automatically actuated to press against the track 14 to provide a braking action, when the control cable 16 has less than the predetermined amount of cable 16 tension. That the control cable 16 has less than the predetermined tension is indicated by the fact that the cable 16 is skewed to the left and has a curved orientation.

More specifically, the cable-tension-responsive track follower 18 is depicted as an oblong brake plate 18 which has a first, relatively short external diameter 20, and has a second, relatively long external diameter 22. The oblong brake plate 18 is positioned on the overhead door 12 so that, when the short external diameter 20 is substantially perpendicular to the track 14 and the long external diameter 22 is substantially parallel to the track 14 (as shown in FIG. 3 which is designated as the first or "normal" position for the brake plate 18), either a gap 24 exists between the brake plate 18 and the track 14, or a smooth surface 26 contact would exist between the brake plate 18 and the track 14. As a result, in the "normal" state, movement of the brake plate 18 against the track 14 is smooth and continuous when the overhead door 12 is in motion.

On the other hand, when the long external diameter 22 of the oblong brake plate 18 is moved from the normal position (shown in FIG. 3) of being substantially parallel to the track 14 to a second position (shown in FIG. 4) approaching being perpendicular to the track 14, (this position being designated as the second or "braking" position for the oblong brake plate 18), the gap 24 that was present in the normal state between the brake plate 18 and the track 14 is eliminated, and a rough surface 28 contact takes place between the oblong brake plate 18 and the track 14. As a result, in the "braking" state, movement of the brake plate 18 against the track 14 is braked, and movement of the overhead door 12 is halted.

For controlling the position of the brake plate 18 with respect to the track 14, means are provided to do the following: first, to exert a force which balances a force that results when the cable tension is at the predetermined level in the "normal" position; and, second, to move the brake plate 18 to the "braking" position when the cable 16 no longer maintains the predetermined cable 16 tension.

Figure 2:
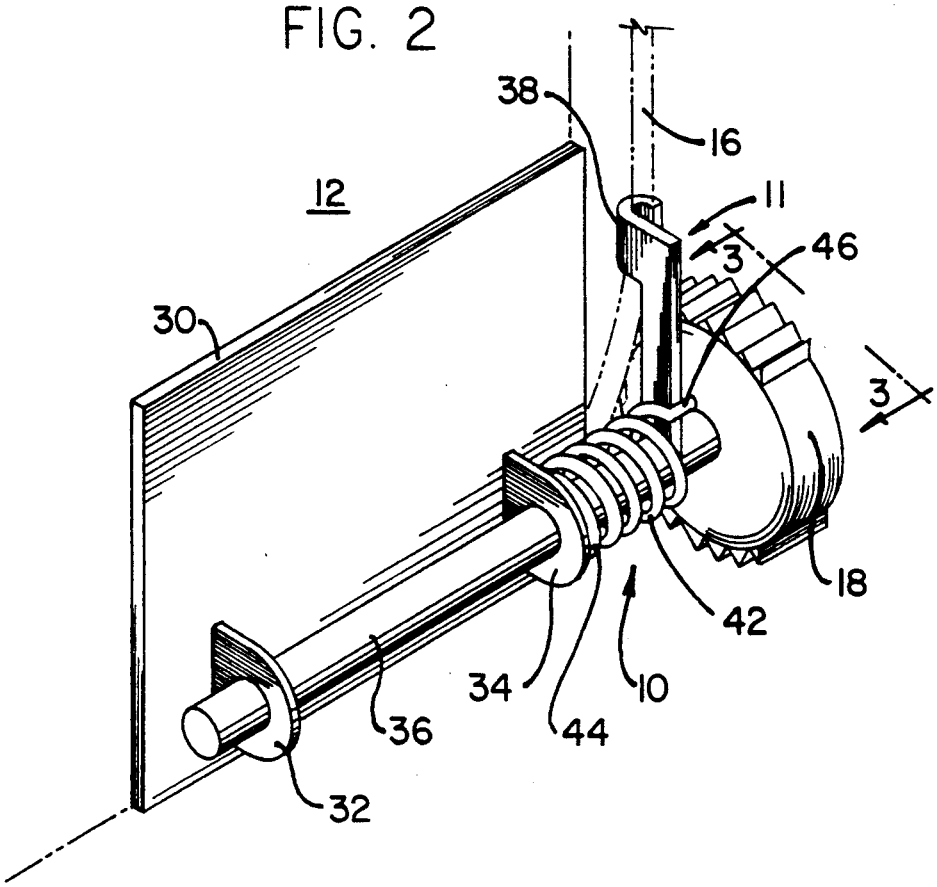
FIG. 2 is an enlarged perspective view of the portion of the embodiment of the invention shown in the circled region 2 of FIG. 1.

More specifically, the means for controlling the position of the brake plate 18 include a bracket 30 attached to the bottommost horizontal panel of the door 12. The bracket 30 includes shaft supports 32 and 34 for supporting a rotatable shaft 36. In this respect, the rotatable shaft 36, being supported by the shaft supports 32 and 34, is connected to the brake plate 18. A restraining arm 38 extends upward from the shaft 36 and contacts the cable 16 which is maintaining the predetermined cable tension (as shown in FIGS. 2 and 3). The predetermined cable 16 tension exerts a clockwise rotational force (represented by curved arrow 40) on the shaft 36 and the brake plate 18.

A shift element, represented by helical spring 42, has one end 44 connected to the support 34 and another end 46 connected to the brake plate 18. The helical spring 42 is arranged such that, it exerts a counterclockwise force (represented by curved arrow 48) that opposes and balances clockwise force 40. The balancing of the opposing forces 40 and 48 takes place on the restraining arm 38. And when these forces are in balance on the restraning arm 38, the restraining arm 38 does not move. And when the restraining arm 38 does not move, neither the shaft 36 nor brake plate 18 will move. In this respect, the balance of forces serves to retain the brake plate 18 in the "normal" position. This balance of forces is maintained as long as the cable maintains the predetermined cable tension.

However, when the cable tension falls below the predetermined tension level, the clockwise force 40 exerted on the restraining arm 38 by the cable tension is eliminated, and forces 40 and 48 are no longer in balance. More specifically, in this case, counterclockwise force 48, which is provided by the helical spring 42, is virtually unopposed, and counterclockwise force 48 exerts a shifting force on the restraining arm 38, causing the restraining arm 38 to move counterclockwise as shown in FIG. 4. Moreover, as the restraining arm 38 moves counterclockwise, so do the shaft 36 and the brake plate 18 which are connected to the restraining arm 38. Thus, under these circumstances, the brake plate 18 shifts to the "braking" position (as shown in FIG. 4). Preferably, the rough surface 28 of the oblong brake plate 18 is provided by a plurality of teeth-like projections 50.

Figure 6:
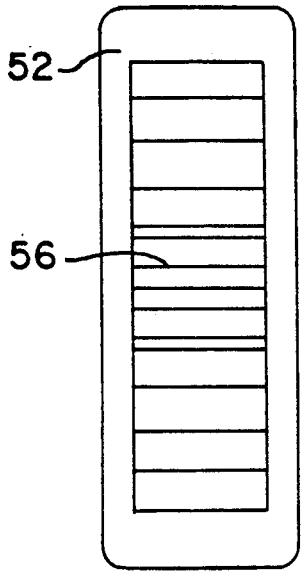
FIG. 6 is a schematic side view of the embodiment of the invention shown in FIG. 5 taken along the line 6—6.
Figure 5:
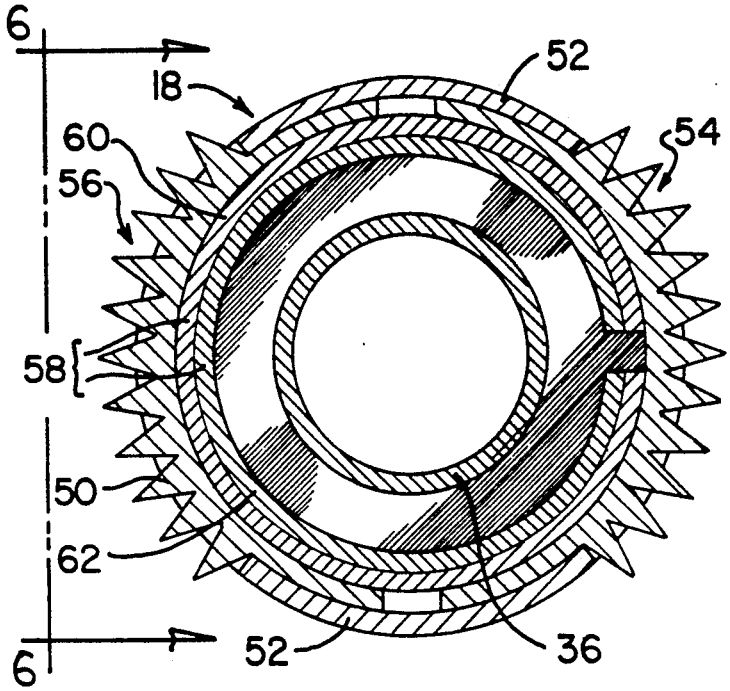
FIG. 5 is a cross-sectional view of a second embodiment of the overhead door safety apparatus of the present invention.

Turning to FIGS. 5 and 6, another embodiment of the overhead door safety apparatus 10 of the invention is disclosed. In FIGS. 5 and 6, reference numerals are shown that correspond to like reference numberals that designate like elements shown in the other figures. In addition, the brake plate 18 includes interior components and exterior surface components. More specifically, the brake plate 18 includes a case member 52, two opposing teeth-containing members 54 and 56 retained by the case member 52, and a cylindrical spring assembly 58 which includes an outermost spring element 60 and an innermost spring element 62. The cylindrical spring assembly 58 is located under the teeth-containing members 54 and 56 and urges the teeth-containing members 54 and 56 outward toward the exterior of brake plate 18.

Figure 7:
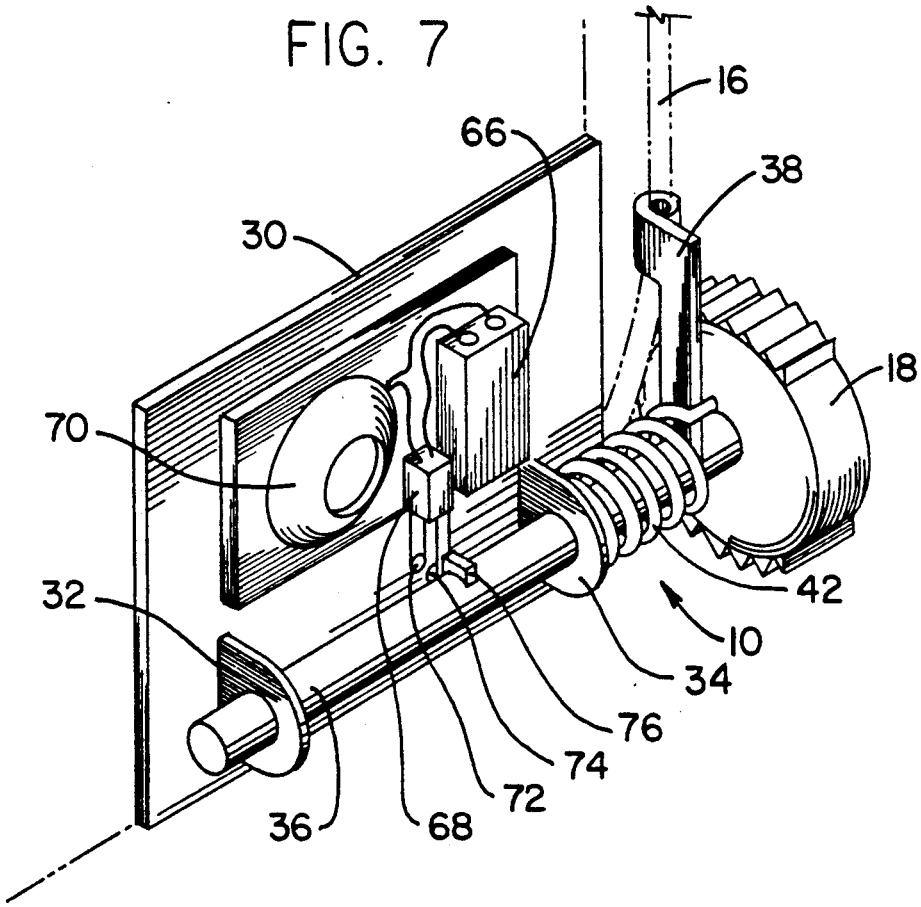
FIG. 7 is a perspective view of a third embodiment of the overhead door safety apparatus of the present invention showing an alarm system that sounds an audible signal when the automatic door brake of the invention is in operation.

Still another embodiment of the overhead door safety apparatus 10 of the invention is shown in FIG. 7 where reference numerals are shown that correspond to like reference numerals that designate like elements shown in the other figures. In addition, in FIG. 7, an alarm system is provided to sound an audible alarm in the event of a cable tension loss and activation of the overhead door safety apparatus 10 of the invention. More specifically, the alarm system includes an alarm circuit which includes a battery power source 66, a cable-tension responsive switch 68 connected to the power source 66, and a sounding buzzer 70 connected to the switch 68 and to the power source 66.

The switch includes contacts 72 and 74 which remain open when the cable 16 is maintained at the predetermined tension (as shown in FIG. 7). However, when cable tension is lost, and the restraining arm 38, the shaft 36, and the brake plate 18 move counterclockwise, a cam 76 on the shaft 36 is rotated (not shown) into a position such that contact 74 is moved into electrical contact with contact 72. As a result, the switch 68 is closed, the alarm circuit is completed, and the buzzer 70 sounds an audible alarm indicating that the brake plate 18 has moved into the "braking" position.

It is apparent from the above that the present invention accomplishes all of the objects set forth by providing a new and improved overhead door safety apparatus that is low in cost, relatively simple in design and operation, and which may advantageously be used to brake movement of an overhead, cable-controlled door in the event of cabke tension failure caused by breakage of a counterbalance spring or breakage of a cable.

The overhead door safety apparatus 10 of the invention can be fabricated from tough metal materials such as 20 guage steel and the like.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only be the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved overhead door safety apparatus for a cable controlled door whose movement is guided by a stationary structure, the apparatus comprising:

a track near the door, and a track follower on the door, where movement of the track follower with respect to said track guides the motion of the door controlled by the control cable, the apparatus comprising:

cable-tension-responsive track follower means, connected to the door, for guiding motion of the door with respect to the track, said cable-tension-responsive track follower means having a first and a second operating state, said first operating state permitting smooth movement of said cable-tension-responsive track follower means with respect to the track when a control cable has a predetermined amount of cable tension, said second operating state providing a brake for movement of said cable-tension-responsive track follower means with respect to the track when a control cable has less than the predetermined amount of cable tension, wherein said cable-tension-responsive track follower means is comprised of: an oblong brake plate having a first, relatively short external diameter, and having a second, relatively long external diameter, said oblong brake plate being positioned on the door such that:

when said short external diameter is substantially perpendicular to the track and said long external diameter is substantially parallel to the track, designated as a first or normal position for said cable-tension-responsive track follower means, either a gap exists between said brake plate and the track or a smooth surface contact exists between said brake plate and the track, whereby movement of said brake plate with respect to the track is smooth and continuous, when said long external diameter is moved from a position of being substantially parallel to the track to a position approaching being perpendicular to the track, designated as a second or braking position for said cable-tension-responsive track follower means, a gap between said brake plate and the track is eliminated, and a rough surface contact exists between said brake plate and the track, whereby movement of said brake plate with respect to the track is braked, and means for controlling the position of said brake plate, said means for controlling exerting a force opposing a predetermined cable tension for retaining said brake plate in said designated normal position when the cable maintains the predetermined cable tension, and said means for controlling moving said brake plate to said braking position when the cable no longer maintains the predetermined cable tension, wherein said brake plate includes interior components and an exterior surface, and said brake plate is comprised of:

a case member;

at least two opposing teeth-containing members retained by said case member;

spring means, placed under said teeth-containing members, for urging said teeth-containing members toward the exterior of said brake member.

2. A new and improved overhead door safety apparatus for an overhead door having a control cable, a track near the door, and a track follower on the door, where movement of the track follower with respect to said track guides the motion of the door controlled by the control cable, the apparatus comprising:

cable-tension-responsive track follower means, connected to the door, for guiding motion of the door with respect to the track, said cable-tension-responsive track follower means having a first and a second operating state, said first operating state permitting smooth movement of said cable-tension-responsive track follower means with respect to the track when a control cable has a predetermined amount of cable tension, said second operating state providing a brake for movement of said cable-tension-responsive track follower means with respect to the track when a control cable has less than the predetermined amount of cable tension, further including:

audible alarm means for sounding an audible alarm when said cable-tension-responsive track follower means is moved to a braking position, wherein said audible alarm means includes an alarm circuit which includes: a power source;

a cable-tension responsive switch connected to said power source;

a sounding device connected to said switch and to said power source;

wherein said switch includes contacts which remain open when the cable is maintained at a predetermined tension, and which close completing a closed alarm circuit when the cable is no longer maintained at the predetermined tension, wherein said cable-tension responsive switch is controlled by a cam attached to said shaft, such that when said brake plate is in a normal position, the cam does not close said contacts, but when said brake plate is in the braking position, the cam closes said contacts, thereby completing a closed alarm circuit and sounding said sounding device.

3. The apparatus described in claim 2 wherein said sounding device is a buzzer.

* * * * *